US006481839B1

(12) United States Patent
Ito

(10) Patent No.: US 6,481,839 B1
(45) Date of Patent: Nov. 19, 2002

(54) FLUID MATERIAL RESERVOIR

(75) Inventor: Wataru Ito, Tanashi (JP)

(73) Assignee: Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 09/486,237

(22) PCT Filed: May 29, 1998

(86) PCT No.: PCT/JP98/02387

§ 371 (c)(1),
(2), (4) Date: Feb. 24, 2000

(87) PCT Pub. No.: WO99/62719

PCT Pub. Date: Dec. 9, 1999

(51) Int. Cl.[7] ..... B41J 2/175
(52) U.S. Cl. ..... 347/86
(58) Field of Search ..... 347/85, 86, 87, 347/35, 36, 22, 28

(56) References Cited

U.S. PATENT DOCUMENTS

| | | | | |
|---|---|---|---|---|
| 5,300,958 A | * | 4/1994 | Burke et al. | 347/28 |
| 5,790,158 A | * | 8/1998 | Shinada et al. | 347/86 |
| 5,900,895 A | * | 5/1999 | Merrill | 347/86 |
| 6,132,036 A | * | 10/2000 | Abe et al. | 347/86 |
| 6,170,937 B1 | * | 1/2001 | Childers et al. | 347/85 |
| 6,276,788 B1 | * | 8/2001 | Hilton | 347/86 |

FOREIGN PATENT DOCUMENTS

| | | |
|---|---|---|
| JP | 62-68494 | 11/1988 |
| JP | 1-242256 A | 9/1989 |
| JP | 08-25642 A | 1/1996 |

* cited by examiner

*Primary Examiner*—Michael Nghiem
(74) *Attorney, Agent, or Firm*—Finnegan, Henderson, Farabow, Garrett & Dunner, L.L.P.

(57) ABSTRACT

An ink-jet printer (10) having a reciprocatingly movable printing head (16) provided with a plurality of nozzles (28) for ejecting ink droplets; a fluid-passage system including an ink supply passage (42) for the printing head and other various fluids passages; and a fluidic-material storage device (62) for storing ink and other various fluidic materials, the fluidic-material storage device being detachably connected to the fluid-passage system. The fluidic-material storage device has a body (66) including a plurality of compartments capable of storing ink and other various fluidic materials in a classified manner; fluid-passing portions (80, 82, 84) provided respectively in the compartments of the body to communicate the compartments with the fluid-passage system; first breakable seal members (86) provided respectively in the fluid-passing portions to interrupt fluid flow in the fluid-passing portions; and second seal members (88) provided in the fluid-passing portions to cover the respective first seal members, the second seal members including apertures (90) for permitting an access of the fluid-passage system to the first seal members.

13 Claims, 6 Drawing Sheets

FLUID MATERIAL RESERVOIR

TECHNICAL FIELD

The present invention relates to a device for storing fluidic materials, and particularly to a fluidic-material storage device usable for an ink-jet printer.

BACKGROUND ART

As non-impact type printers are less noisy during printing of characters or images and can perform color printing, they have been used in various fields. For example, an ink-jet printer wherein ink-droplets are ejected from a number of micro-nozzles provided in a printing head onto a material to be printed to carry out a printing operation, and particularly an on-demand type ink-jet printer wherein piezoelectric elements are used in the printing head, has recently prevailed, as an output device for personal computers or word processors, because it can print on a plain paper and the printer body thereof is small.

On the other hand, impact type printers have relatively simple structures which makes the maintenance thereof easy and have advantages in running cost due to, e.g., an inexpensive ink ribbon, and thus have widely been used as printers for industrial use, such as a printer for printing on a bankbook or a slip in a bank (hereinafter referred to as a bankbook printer). Nowadays, however, even in the field of bankbook printers, requirements have been risen for, e.g., noise reduction, small size and an improvement in operation time (i.e., a time period required for user's operation between the introducing of a bankbook into the printer and the retaking thereof after it is printed). Therefore, it becomes difficult to satisfy these requirements with the impact type printer.

One problem to be solved when an ink-jet printer is used as an industrial printer is a capacity of an ink storage section. Since the frequency of use of the industrial printer is remarkably larger than that of the personal printer, it is desired for the ink storage section of the industrial printer to have a sufficient capacity, so as to increase ink-replenishment intervals and reduce an ink-replenishment load.

Conventionally, as an ink storage section provided for an ink-jet printer, a head-mount type mounted on a printing head and a separate type placed apart from the printed head have been known. The head-mount type ink storage section has an advantage that an ink-supply passage connecting the ink storage section with the printing head is short and ink in the ink-supply passage is thus hardly influenced by inertia when the printing head is moving. However, it is generally difficult to increase the capacity of the ink storage section of this type since the dimensions and weight of the ink storage section directly influence the mobility of the printed head. Accordingly, the ink-jet printer for the industrial use generally uses a separate-type ink storage section of which the capacity can be easily increased.

In either of the head-mount or separate ink storage section, a cartridge type ink tank is usually adopted, which is detachably mounted in relation to an ink-supply system of the printer, to facilitate the ink replenishment work. In the cartridge type ink tank, a sleeve-like ink outlet formed in a tank wall is sealed by a easily-breakable seal member, so as to prevent ink from leaking through the ink outlet during stocking and transportation of the tank. On the other hand, a coupler including a connecting tube element with a tapered tip end is placed at one end of the ink-supply passage of the ink-jet printer. When the ink tank is attached to the ink-supply system, the seal member is pierced by the connecting tube element of the coupler to open the ink outlet and, simultaneously, the ink is discharged through the connecting tube element into the ink-supply passage.

The seal member provided to the ink outlet of the conventional ink tank is composed of a rubber packing inserted into the ink outlet and a seal plate arranged outside the packing to cover the ink outlet. The packing is previously provided with an aperture capable of tightly receiving the connecting tube element. The connecting tube element is inserted into the aperture of the packing immediately after piercing the seal plate, so that the ink outlet is opened and sealed to the connecting tube element.

According to this structure, however, the ink has already permeated between the seal plate and the packing through the aperture of the packing before the seal plate is pierced, and therefore, a problem arises in that a small amount of ink leaks the instant the seal plate is pierced.

Incidentally, in an ink-jet printer for industrial use, a storage section for a washing liquid used for washing the nozzles and/or of a waste ink sucked and removed from the nozzles is sometimes provided, as fluidic-material storage sections other than the ink storage section, in a maintenance mechanism for eliminating nozzle clogging. In this case, the ink storage section as well as a washing-liquid storage section and a waste-ink storage section have their respective replenishment/replacement intervals different from one another, and thus are generally provided in the printer independently from one another. Consequently, the replenishment/replacement work of the fluidic materials becomes troublesome, and if cartridge type tanks are used for various fluidic materials, a complicated management of the cartridges is required.

DISCLOSURE OF THE INVENTION

An object of the present invention is to provide a fluidic-material storage device detachably coupled to a fluid passage system, which can effectively prevent the possible leakage of fluidic materials when it is attached to the fluid passage system.

Another object of the present invention is to provide a fluidic-material storage device usable as an ink storage section detachably coupled to an ink-supply system of an ink-jet printer, which can effectively prevent the possible leakage of ink when it is attached to the ink-supply system.

A further object of the present invention is to provide a fluidic-material storage device usable as a storage section for various fluidic materials in an ink-jet printer, which can simplify the replenishment and replacement works of various fluidic materials.

A yet further object of the present invention is to provide the above types of fluidic-material storage device which can be used as a large capacity ink storage section detachably mounted to an ink-jet printer apart from a printing head thereof.

A still further object of the present invention is to provide an ink-jet printer provided with the above types of fluidic-material storage device, which can be used as an industrial printer such as a bankbook printer.

To accomplish the above objects, the present invention provides a fluidic-material storage device, comprising a body including a plurality of compartments capable of storing various fluidic materials in a classified manner; fluid-passing portions provided respectively in the compartments of the body to communicate the compartments with an external fluid-passage system; first breakable seal members provided respectively in the fluid-passing portions to interrupt fluid flow in the fluid-passing portions; and second seal members provided in the fluid-passing portions to respectively cover the first seal members, the second seal members including apertures for permitting access to the first seal members.

In the above fluidic-material storage device, it is preferred that the second seal members are formed from rubber packings.

The present invention also provides a fluidic-material storage device for an ink-jet printer incorporating therein a reciprocatingly movable printing head provided with a plurality of nozzles for ejecting ink droplets and a fluid-passage system including an ink supply passage for the printing head and other various fluids passages, the device comprising a body detachably connected to the fluid-passage system, the body including a plurality of compartments capable of storing ink and other various fluidic materials in a classified manner; fluid-passing portions provided respectively in the compartments of the body to communicate the compartments with the fluid-passage system; first breakable seal members provided respectively in the fluid-passing portions to interrupt a fluid flow in the fluid-passing portions; and second seal members provided in the fluid-passing portions to respectively cover the first seal members, the second seal members including apertures for permitting an access of the fluid-passage system to the first seal members.

In the above fluidic-material storage device, it is preferred that the second seal members are formed from rubber packings.

It is also advantage that the compartments of the body constitute ink storage sections connected to the ink supply passage.

In this arrangement, it is preferred that at least one of the compartments of the body constitutes a storage section for a washing liquid used for washing the nozzles of the printing head.

Alternatively, it is preferred that at least one of the compartments of the body constitutes a storage section for a waste ink removed from the nozzles of the printing head.

The present invention further provides an ink-jet printer, comprising a reciprocatingly movable printing head provided with a plurality of nozzles for ejecting ink droplets; a fluid-passage system including an ink supply passage for the printing head and other various fluids passages; and a fluidic-material storage device for storing ink and other various fluidic materials, the fluidic-material storage device being detachably connected to the fluid-passage system; the fluidic-material storage device comprising a body including a plurality of compartments capable of storing ink and other various fluidic materials in a classified manner; fluid-passing portions provided respectively in the compartments of the body to communicate the compartments with the fluid-passage system; first breakable seal members provided respectively in the fluid-passing portions to interrupt a fluid flow in the fluid-passing portions; and second seal members provided in the fluid-passing portions to respectively cover the first seal members, the second seal members including apertures for permitting an access of the fluid-passage system to the first seal members.

In the above ink-jet printer, it is preferred that the second seal members of the fluidic-material storage device are formed from rubber packings.

It is also advantage that the compartments of the body of the fluidic-material storage device constitute ink storage sections connected to the ink supply passage.

In this arrangement, the fluidic-material storage device may be placed apart from the printing head, and the ink supply passage may be formed of a flexible tube extending between the ink storage sections of the fluidic-material storage device and the printing head.

It is also preferred that at least one of the compartments of the body of the fluidic-material storage device constitutes a storage section of a washing liquid used for washing the nozzles of the printing head.

Alternatively, it is preferred that at least one of the compartments of the body of the fluidic-material storage device constitutes a storage section of a waste ink removed from the nozzles of the printing head.

The ink-jet printer as described above may be used as a bankbook printer.

BRIEF DESCRIPTION OF THE DRAWINGS

The above and other objects, features and advantages of the present invention will be described with reference to the embodiments shown in the attached drawings, wherein.

BEST MODES FOR CARRYING OUT THE INVENTION

Figure 1:
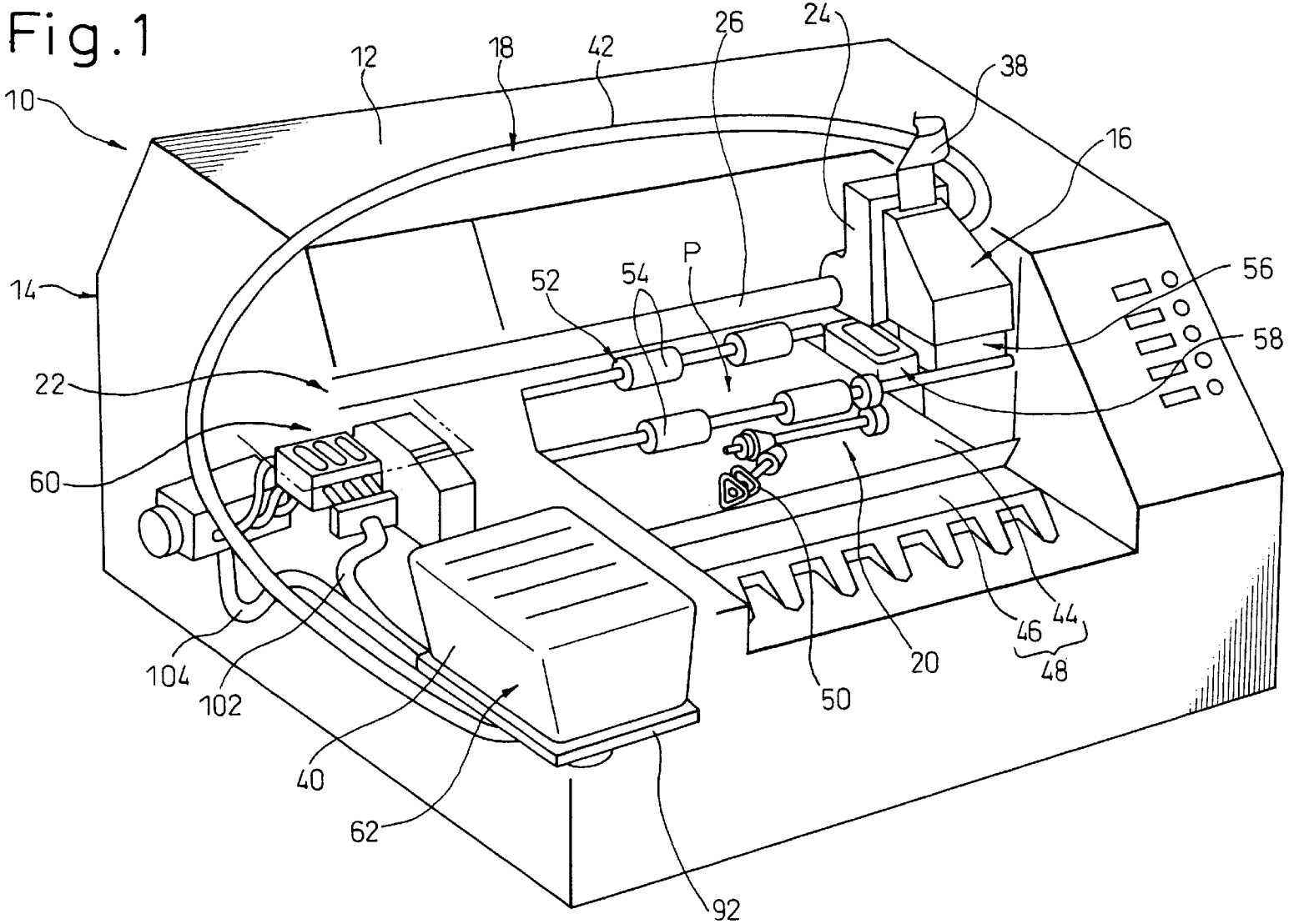
FIG. 1 is a schematic perspective view showing, in a partially cut-out manner, main components of an ink-jet printer provided with a fluidic-material storage device according to one embodiment of the present invention.

With reference to the drawings, FIG. 1 is a schematic perspective view showing, in a partially cut-out manner, main components of an ink-jet printer 10 according to one embodiment of the present invention.

The ink-jet printer 10 is provided with a machine frame 14 including an openable/closable housing 12 and a machine body not shown, a printing head 16 provided reciprocatingly movably in a predetermined direction (usually in a horizontal direction relative to a reference plane on which the printer is installed) in the machine frame 14, ink-supply means 18 for supplying ink to the printing head 16, material-feeding means 20 for feeding a material to be printed (not shown) into a printing area P opposed to the printing head 16 in the machine frame 14, and maintenance means 22 including a plurality of functional stations arranged in a distributed manner in opposite end regions of the reciprocation range of the printing head 16 in the machine frame 14.

The printing head 16 is fixed to a carriage 24 which, in turn, is carried on a guide bar 26 extending in the horizontal direction in the machine frame 14 so as to be slidingly movable in the axial direction of the bar. During the printing operation, the printing head 16 is reciprocated in the horizontal direction along the guide bar 26 by means of a driving mechanism not shown.

Figure 2:
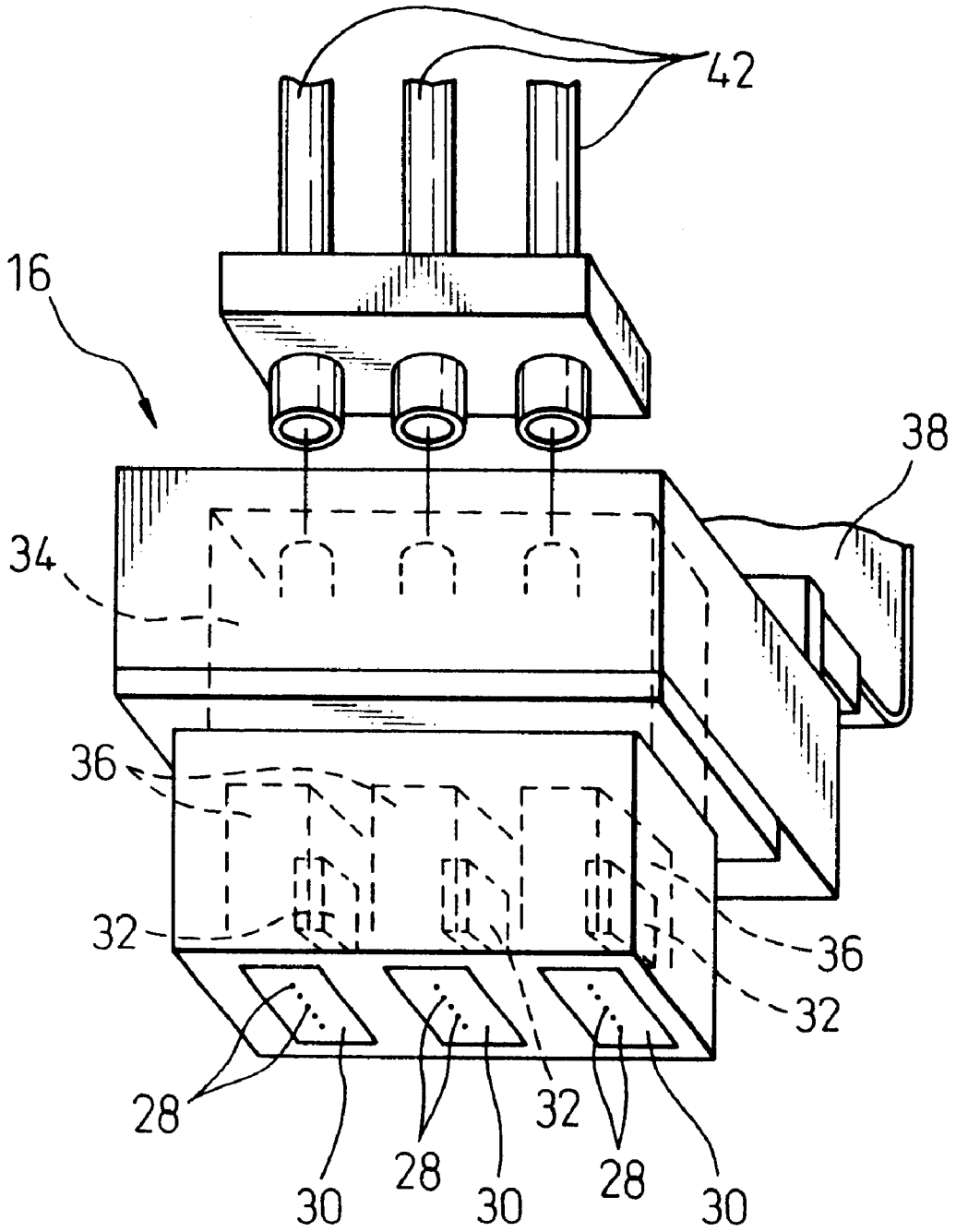
FIG. 2 is a schematic perspective view of a printing head of the ink-jet printer shown in FIG. 1.

As schematically shown in FIG. 2, the printing head 16 is provided with a plurality of nozzles 28 for ejecting ink-droplets, a nozzle surface 30 onto which the nozzles 28 open, an actuator 32 composed of piezoelectric elements for making the nozzles 28 eject ink-droplets, and an inner pressure adjustment device or a damper 34 for stabilizing a meniscus of the ink entering the respective nozzles 28. In the illustrated embodiment, the printing head 16 includes separate three subheads 36, each of which is provided with the plural nozzles 28, the nozzle surface 30 and the actuator 32. A flexible circuit board 38 for applying a driving voltage onto the actuator 32 is shown in FIGS. 1 and 2.

As shown in FIG. 1, the ink-supply means 18 is provided with an ink storage section 40 arranged at a position apart from the printing head 16 in the machine frame 14, and an ink supply conduit 42 connecting the printing head 16 with the ink storage section 40, to supply an ink (e.g., a pigment ink) to the printing head 16 during the printing operation. In the illustrated embodiment, the ink supply conduit 42 is formed of a sufficiently flexible tube so as not to interfere with the reciprocating motion of the printing head 16.

The material-feeding means 20 disposed beneath the reciprocation range of the printing head 16 includes a material-holding section 48 having an upper fixed plate 44 and a lower movable plate 46 and holding the material to be printed, such as a printing paper or a bankbook, inserted between the plates 44, 46, a correcting mechanism 50 arranged above the fixed plate 44 for correcting the feeding direction of the material to be printed held in the material-holding section 48, and a feeding mechanism 52 disposed above the fixed plate at a position behind the correcting mechanism 50 in the material-feeding direction, for introducing the material to be printed held in the material-holding section 48 into the printing area P and discharging the same from the printing area P.

The printing area P is defined between two pairs of feed rollers 54 constituting the feeding mechanism 52. The printing head 16 reciprocates along the guide bar 26 above the printing area P, and scans the material to be printed introduced into the printing area P while forming characters or images on the material to be printed by ejecting ink droplets from the nozzles 28.

The plural functional stations constituting the maintenance means 22 include a sealing station 56 for substantially sealing and covering the plural nozzles 28 opening on the nozzle surface 30 of the printing head 16 when the printer does not operate, so as to prevent the ink in the nozzles 28 from drying, a discharging station 58 for making the nozzles 28 of the printing head 12 discharge the ink of which the viscosity has increased in the nozzles 28 during the inoperative state of the printer, and a cleaning station 60 for sucking and removing the ink of which the viscosity has increased in the nozzles 28 during the inoperative state of the printer and for washing and wiping the nozzle surface 30. In the illustrated embodiment, the sealing station 56 and the discharging station 58 are disposed in one end region (a right end region in the drawing) of the reciprocation range of the printing head, and the cleaning station 60 is disposed in another end region (a left end region in the drawing) of the reciprocation range of the printing head.

Such a distributive arrangement of the various functional stations facilitates the effective utilization of all idle space in the machine frame 14 of the ink-jet printer 10. That is, in the general ink-jet printer, since the printing operation is carried out on the material to be printed while the printing head reciprocates in the predetermined direction, the reciprocation range of the printing head is determined to be wider than a dimension of the material-feeding device disposed opposite to the printing head. As a result, an idle space is inevitably formed around the material-feeding device. Therefore, in the ink-jet printer 10, the above-mentioned various functional stations for establishing a multifunctional maintenance system are distributively arranged in the idle space, so as to effectively prevent the machine size from being enlarged. Further, the ink-jet printer 10 having such a multifunctional maintenance system can safely use pigment ink, and thus can be suitably applied to printers for industrial use, e.g., to a bankbook printer.

Figure 3:
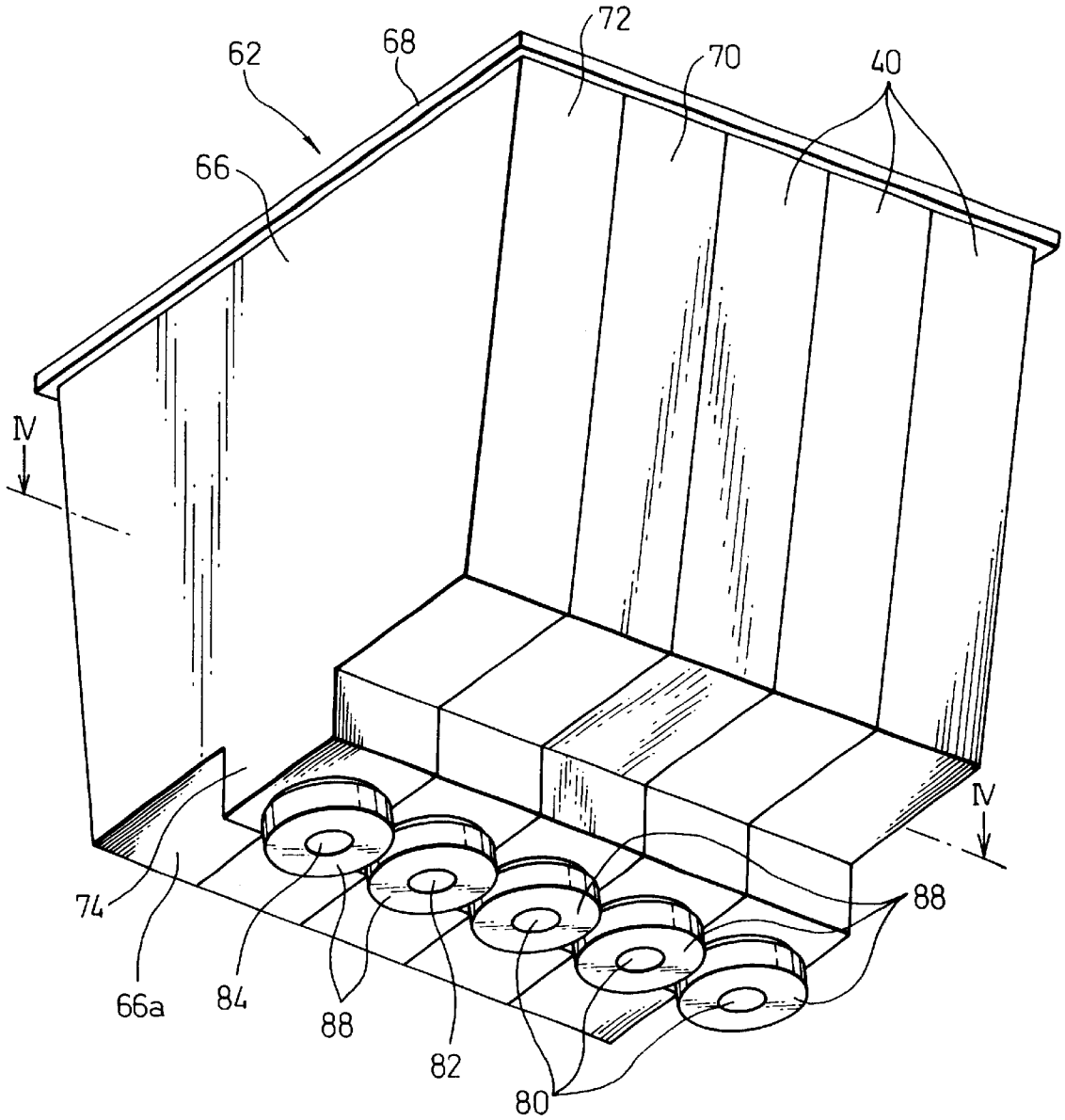
FIG. 3 is a schematic perspective view of the fluidic-material storage device according to one embodiment of the present invention.
Figure 4:
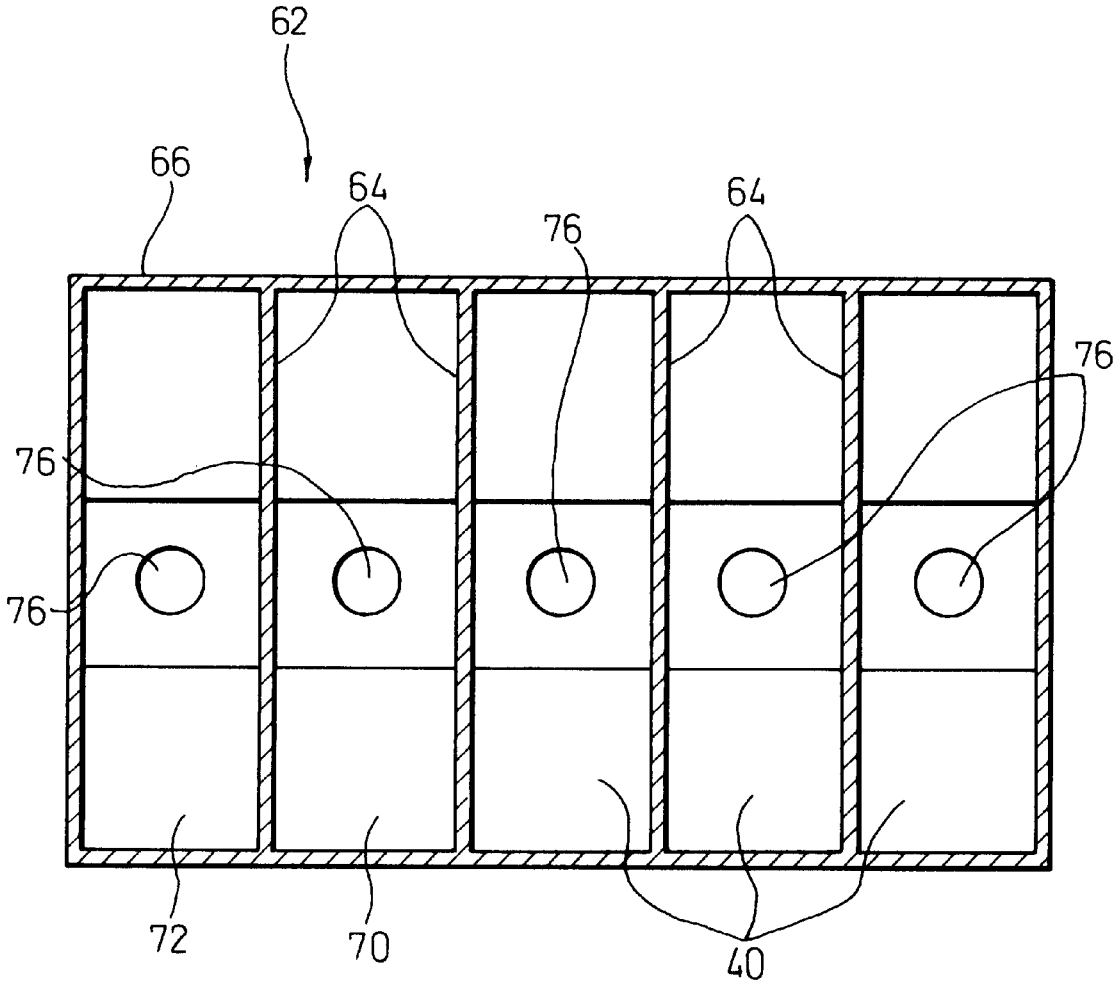
FIG. 4 is a sectional view of the fluidic-material storage device, taken along a line IV—IV of FIG. 3.

A fluidic-material storage device 62, according to one embodiment of the present invention, to be provided in the ink-jet printer 10, is formed as a cartridge type tank having a plurality of fluidic-material storage sections including the above-described ink storage section 40, and is detachably placed at a predetermined position in the machine frame 14 apart from the printing head 16. As shown in FIGS. 3 and 4, the fluidic-material storage device 62 includes a tank-shaped body 66 opening at the upper end thereof and having five compartments separated by partition walls 64 and a cover 68 for closing the upper end opening of the body 66. The five compartments separated by the partition walls 64 store various fluidic materials including the ink in a classified manner, respectively, and are coupled to a fluid-passage system including the ink supply conduit 42 of the ink-jet printer 10.

In the illustrated embodiment, mutually adjacent three of the five compartments of the body 66 constitute mutually independent ink storage sections 40, respectively. Also, two compartments adjacent to the ink storage sections 40 respectively constitute a washing-liquid storage section 70 for storing a washing liquid to be supplied to the cleaning part of the cleaning station 60 of the ink-jet printer 10 as described before and a waste-liquid storage section 72 for storing a waste ink collected from the sucking part of the cleaning station 60. In this respect, the number and purpose of the compartments, in the present invention, should not be limited to those disclosed in the above arrangement.

Figure 5A:
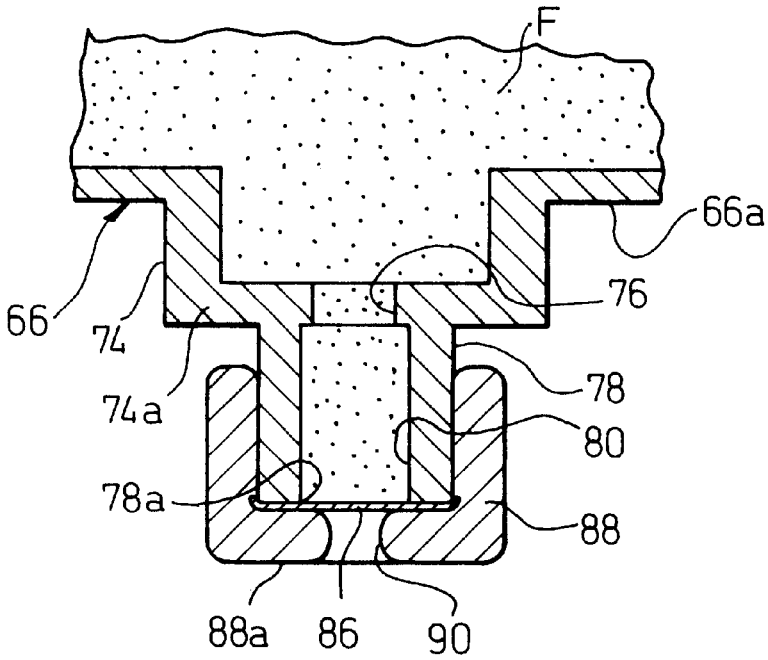
FIG. 5A is a partially enlarged sectional view of the fluidic-material storage device of FIG. 3.

The body 66 is provided at the bottom 66*a* thereof with an outwardly projecting rib 74 lying across all the compartments and generally at the center of the respective compartments, and holes 76 are formed through a bottom wall 74*a* of the rib 74, one hole being provided for each compartment. The bottom wall 74*a* of the rib 74 is also provided with cylindrical portions 78 individually projecting outward, one portion being provided for each compartment (FIG. 5A). Each hole 76 communicates in a fluidic communicative manner with the interior space of each compartment to the interior space of each cylindrical portion 78. In this manner, the bottom 66*a* of the body 66 is provided, as fluid-passing portions, with ink outlets 80 of the respective ink storage sections 40, a washing liquid outlet 82 of the washing-liquid storage section 70 and a waste liquid inlet 84 of the waste-liquid storage section 72.

The cylindrical portions 78 of the bottom 66*a* of the body 66 are provided respectively with seal means for interrupting a fluid flow of the respective fluid-passing portions so as to prevent the leakage of the fluidic materials from the fluid-passing portions during the stock and transportation of the fluidic-material storage device 62. As shown in FIG. 5A, the seal means in the fluidic-material storage device 62 are constituted from seal plates 86 as first seal members for hermetically sealing the openings of the free ends 78*a* of the respective cylindrical portions 78, and packings 88 as second seal members arranged to cover the seal plates 86 and the cylindrical portions 78 at locations outside the respective seal plates 86.

Each seal plate 86 is a lamination made of materials, such as resinous film or paper, which can be broken by a tapered tip-ended member, and is fixedly secured to the free end 78*a* of each cylindrical portion 78 by, e.g., an adhesive. Each packing 88 is a cap-shaped member made of elastic materials such as rubber, and is closely attached to the cylindrical portion 78 under the elastic force. The packing 88 is provided at the center of the end wall 88*a* thereof with an aperture 90 opening therethrough, and thereby a corresponding tip-ended member provided at the passage end of the fluid-passage system of the ink-jet printer can access to the seal plate 86. Each aperture 90 has a diametric dimension capable of tightly receiving the corresponding tip-ended member under the elastic force. In this arrangement, the fluidic material (e.g., ink F in FIG. 5A) filled in each compartment enters the interior space of the fluid-passing part through the hole 76 of the body bottom 66*a* to be in contact with the seal plate 86.

Figure 5B:
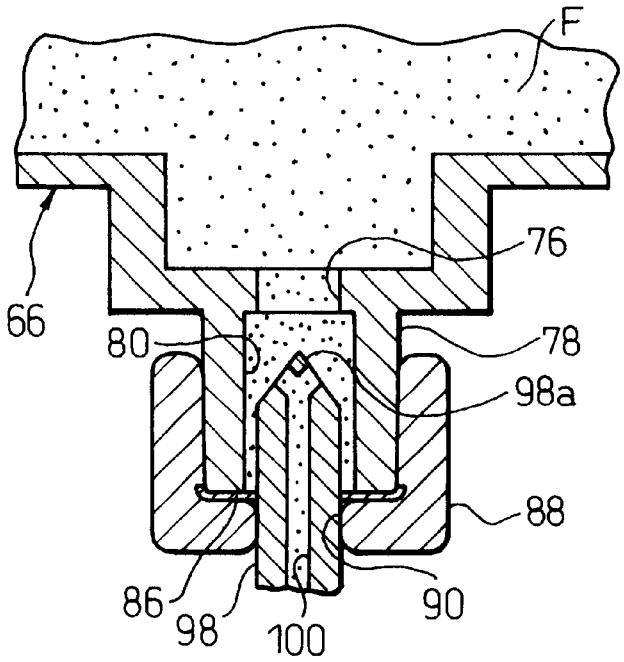
FIG. 5B is a partially enlarged sectional view of the fluidic-material storage device of FIG. 3, in an operative state.
Figure 6:
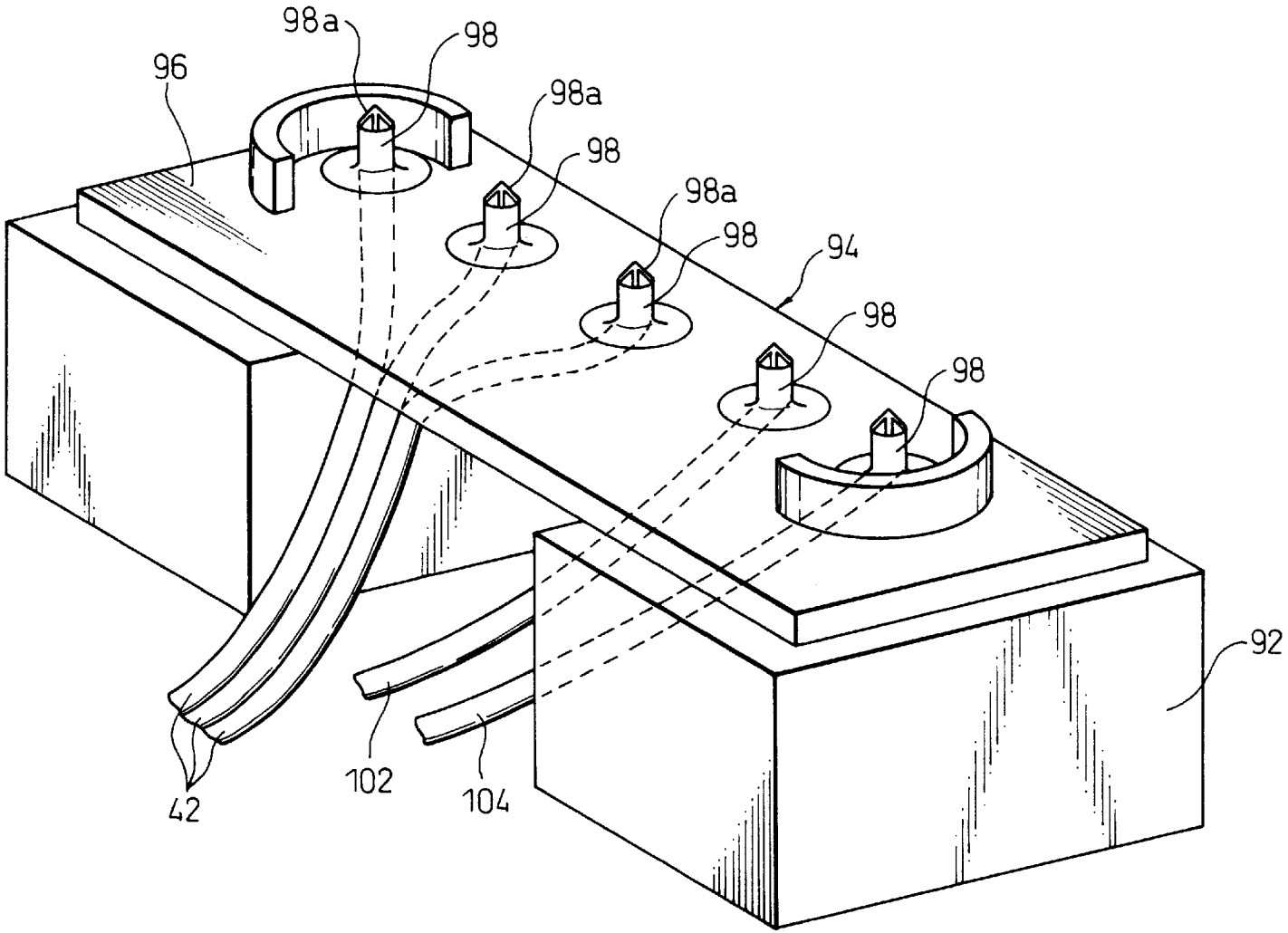
FIG. 6 is an enlarged perspective view of a coupler provided in the ink-jet printer of FIG. 1.

In correspondence with the fluidic-material storage device 62 having the above arrangement, the ink-jet printer 10 is provided at a predetermined location in the machine frame 14 with a supporting block 92 for detachably supporting the fluidic-material storage device 62. As shown in FIG. 6, a coupler 94 is fixedly mounted on the supporting block 92 to connect the respective compartments of the fluidic-material storage device 62 with various fluid passages of the ink-jet printer 10. The coupler 94 includes a base plate 96 fixed to the supporting block 92, and five connecting tube elements 98 arranged in a row on one side of the base plate 96 and respectively provided with tapered tip ends 98*a*. Each connecting tube element 98 constitutes the corresponding tip-ended member to be received in each packing 88 of the fluidic-material storage device 62, and has an axially penetrating fluid channel 100 in the interior thereof (FIG. 5B). Each fluid channel 100 branches at one end thereof to open on the tip end 98*a* of the connecting tube element 98, and is connected at the other end thereof with one of the various fluid passages of the ink-jet printer 10.

In the illustrated embodiment, the ink supply conduit 42 of the ink-jet printer 10 is formed as three separate ink supply conduits 42 (FIGS. 2 and 6), and the mutually adjacent three connecting tube elements 98 of the coupler 94 are respectively connected to three ink supply conduits 42. According to this arrangement, it is possible to individually connect three ink storage sections 40 of the fluidic-material storage device 62 to three subheads 36. Thereby, it is also possible to use the ink-jet printer 10 as a color printer. One of the remaining connecting tube elements 98 is connected through a washing-liquid conduit 102 to the washing part of the cleaning station 60, and another one of them is connected through a waste-liquid conduit 104 to the sucking part of the cleaning station 60. In this respect, the number of the subheads 36 and ink supply conduits 42 is not limited to three but may be selected to be any optional number.

When the respective compartments of the fluidic-material storage device 62 are connected to the various fluid passages of the ink-jet printer 10, the fluidic-material storage device 62 is placed on the coupler 94, and the connecting tube elements 98 of the coupler 94 are inserted respectively into the corresponding ink outlets 80, washing liquid outlet 82 and waste liquid inlet 84, preferably in a simultaneous manner. At this time, as shown in FIG. 5B, the tip end 98*a* of each connecting tube element 98 is initially inserted into the aperture 90 of each packing 88, and thereby the packing 88 is brought into close contact with the connecting tube element 98 under the elastic force of the packing. Immediately thereafter, the tip ends 98*a* of the respective connecting tube elements 98 pierce through the seal plates 86, so that the ink outlets 80, the washing liquid outlet 82 and the waste liquid inlet 84 are opened. As a result, the ink storage sections 40, the washing-liquid storage section 70 and the waste-liquid storage section 72 are connected through the fluid passes 100 of the respective connecting tube elements 98 with the ink supply conduits 42, the washing liquid conduit 102 and the waste liquid conduit 104.

As described above, according to the fluidic-material storage device 62, an interface between the packing 88 and the connecting tube element 98 is previously sealed by the elastic force of the packing 88, prior to the seal plate 86 is pierced by the connecting tube element 98 of the coupler 94, and thereby the leakage of ink or washing liquid when the seal plate 86 is broken is effectively prevented.

Also, the ink storage sections 40, the washing-liquid storage section 70 and the waste-liquid storage section 72 are assembled and integrated into a single fluidic-material storage device 62, so that it is possible to simultaneously carry out the replenishment of ink and waste liquid as well as the disposal of waste ink to simplify these works, and thereby reducing a load of the operator. In this case, it is possible to previously optimize the capacity of the respective compartments of the body 66 in correspondence to the generally expected replenishment/replacement intervals for various fluidic materials to be stored. In the case where a pigment ink is used in the ink-jet printer 10, the intervals of the disposal of waste ink and of the replacement of tank may be shorter than the case where a dyestuff ink is used, and therefore, the fluidic-material storage device 62, in which the disposal of ink is carried out at the same time as the replenishment thereof, is effectively used.

Further, the fluidic-material storage device 62 can be used as a large capacity ink storage section detachably provided to the ink-jet printer 10 apart from the printing head 16. In this case, the ink-jet printer 10 can be used as an industrial printer such as a bankbook printer. It will be understood, however, that the present invention may be applied as a head-mount type ink storage section.

INDUSTRIAL APPLICABILITY

The present invention provides a fluidic-material storage device, which can effectively prevent the possible leakage of fluidic materials when it is attached to the fluid passage system. Accordingly, the present invention can be used with high reliability as various fluidic-material storage sections detachably coupled to an ink supply passage and other various fluid passages of an ink-jet printer. Further, when the fluidic-material storage device is used as a large capacity ink storage section detachably mounted apart from a printing head, it is possible to use the ink-jet printer as an industrial printer such as a bankbook printer.

What is claimed is:

1. A fluidic-material storage device, comprising:

a body including a plurality of compartments capable of storing various fluidic materials in a classified manner;

fluid-passing portions provided respectively in said compartments of said body to communicate said compartments with an external fluid-passage system;

first breakable seal members provided respectively on said fluid-passing portions to interrupt fluid flow from said fluid-passing portions; and second seal members provided respectively outside of and covering said first seal members, each of said second seal members including an aperture for permitting an object to be inserted through said aperture for access to each of said first seal members, each of said second seal members having a portion for making sealing contact with the object inserted through said aperture.

2. A fluidic-material storage device as defined in claim 1, wherein said second seal members are formed from rubber packings.

3. A fluidic-material storage device for an ink-jet printer incorporating therein a reciprocatingly movable printing head provided with a plurality of nozzles for ejecting ink droplets and a fluid-passage system including an ink supply passage for said printing head and other various fluids passages, the device comprising:

a body detachably connected to said fluid-passage system, said body including a plurality of compartments capable of storing ink and other various fluidic materials in a classified manner;

fluid-passing portions provided respectively in said compartments of said body to communicate said compartments with said fluid-passage system;

first breakable seal members provided respectively on said fluid-passing portions to interrupt fluid flow from said fluid-passing portions; and second seal members provided respectively outside of and covering said first seal members, each of said second seal members including an aperture for permitting an object to be inserted through said aperture for access to each of said first seal members, each of said second seal members having a portion for making sealing contact with the object inserted through said aperture.

4. A fluidic-material storage device as defined in claim 3, wherein said second seal members are formed from rubber packings.

5. A fluidic-material storage device as defined in claim 3, wherein said compartments of said body constitute ink storage sections connected to said ink supply passage.

6. A fluidic-material storage device as defined in claim 5, wherein at least one of said compartments of said body constitutes a storage section of a waste ink removed from said nozzles of said printing head.

7. An ink-jet printer, comprising:

a reciprocatingly movable printing head provided with a plurality of nozzles for ejecting ink droplets;

a fluid-passage system including an ink supply passage for said printing head and other various fluids passages; and a fluidic-material storage device for storing ink and other various fluidic materials, said fluidic-material storage device being detachably connected to said fluid-passage system;

said fluidic-material storage device comprising:

a body including a plurality of compartments capable of storing ink and other various fluidic materials in a classified manner;

fluid-passing portions provided respectively in said compartments of said body to communicate said compartments with said fluid-passage system;

first breakable seal members provided respectively on said fluid-passing portions to interrupt fluid flow from said fluid-passing portions; and second seal members provided respectively outside of and covering said first seal members, each of said second seal members including an aperture for permitting an object to be inserted through said aperture for access of said fluid-passage system to each of said first seal members, each of said second seal members having a portion for making sealing contact with the object inserted through said aperture.

8. An ink-jet printer as defined in claim 7, wherein said second seal members of said fluidic-material storage device are formed from rubber packings.

9. An ink-jet printer as defined in claim 7, wherein said compartments of said body of said fluidic-material storage device constitute ink storage sections connected to said ink supply passage.

10. An ink-jet printer as defined in claim 9, wherein said fluidic-material storage device is placed apart from said printing head, and wherein said ink supply passage is formed of a flexible tube extending between said ink storage sections of said fluidic-material storage device and said printing head.

11. An ink-jet printer as defined in claim 9, wherein at least one of said compartments of said body of said fluidic-material storage device constitutes a storage section of a waste ink removed from said nozzles of said printing head.

12. A fluidic-material storage device for an ink-jet printer incorporating therein a reciprocatingly movable printing head provided with a plurality of nozzles for ejecting ink droplets and a fluid-passage system including an ink supply passage for said printing head and other various fluids passages, the device comprising:

a body detachably connected to said fluid-passage system, said body including a plurality of compartments capable of storing ink and other various fluidic materials in a classified manner;

fluid-passing portions provided respectively in said compartments of said body to communicate said compartments with said fluid-passage system;

first breakable seal members provided respectively on said fluid-passing portions to interrupt fluid flow from said fluid-passing portions; and second seal members provided respectively outside of and covering said first seal members, said second seal members including apertures for permitting access of said fluid-passage system to said first seal members;

wherein said compartments of said body include ink storage sections connected to said ink supply passage, and wherein at least one of said compartments of-said body constitutes a storage section of a washing liquid used for washing said nozzles of said printing head.

13. An ink-jet printer, comprising:

a reciprocatingly movable printing head provided with a plurality of nozzles for ejecting ink droplets;

a fluid-passage system including an ink supply passage for said printing head and other various fluids passages; and a fluidic-material storage device for storing ink and other various fluidic materials, said fluidic-material storage device being detachably connected to said fluid-passage system;

said fluidic-material storage device comprising:

a body including a plurality of compartments capable of storing ink and other various fluidic materials in a classified manner;

fluid-passing portions provided respectively in said compartments of said body to communicate said compartments with said fluid-passage system;

first breakable seal members provided respectively on said fluid-passing portions to interrupt fluid flow from said fluid-passing portions; and second seal members provided respectively outside of and covering said first seal members, said second seal members including apertures for permitting access of said fluid-passage system to said first seal members;

wherein said compartments of said body of said fluidic-material storage device include ink storage sections connected to said ink supply passage, and wherein at least one of said compartments of said body of said fluidic-material storage device constitutes a storage section of a washing liquid used for washing said nozzles of said printing head.

* * * * *